US006113407A

United States Patent [19]

Martin

[11] Patent Number: 6,113,407

[45] **Date of Patent: *Sep. 5, 2000**

[54] ELECTRICAL CONNECTOR WITH GAS EXCHANGE MEMBRANE

[75] Inventor: Galen Monroe Martin, Troy, Mich.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/163,927

[22] Filed: Sep. 30, 1998

[51] Int. Cl.[7] ..... H01R 4/60

[52] U.S. Cl. ..... 439/205; 439/206

[58] Field of Search ..... 439/205, 206, 439/198, 199, 278, 283, 201, 190, 936, 933, 197

[56] References Cited

U.S. PATENT DOCUMENTS

| | | | |
|---|---|---|---|
| 3,412,365 | 11/1968 | Nelson | 439/281 |
| 3,546,657 | 12/1970 | Cook | 439/205 |
| 4,828,507 | 5/1989 | Nagase et al. | 439/206 |
| 5,356,420 | 10/1994 | Cairns et al. | 439/206 |
| 5,358,420 | 10/1994 | Cairns et al. | 439/206 |
| 5,478,251 | 12/1995 | Jaklin | 439/157 |
| 5,522,769 | 6/1996 | DeGuiseppi | 454/270 |
| 5,595,907 | 1/1997 | Kayal et al. | 435/288.1 |
| 5,618,194 | 4/1997 | Maue et al. | 439/157 |
| 5,685,729 | 11/1997 | Reider et al. | 439/206 |
| 5,766,026 | 6/1998 | Cooper et al. | 439/76.1 |
| 5,766,936 | 6/1998 | Kayal et al. | 435/297.1 |
| 5,820,825 | 10/1998 | Weinzieri et al. | 422/102 |
| 5,853,096 | 12/1998 | Bartur et al. | 215/261 |
| 5,882,454 | 3/1999 | Baginski et al. | 156/73.5 |

OTHER PUBLICATIONS

Pall Gelman Sciences Product Data Sheet entitled FlurRepel (TM) Versaapor (R) Membrane.

Pall Gelman Sciences Product Data Sheet entitled Hydrolon (TM) Nylon 6,6 Membrane.

AMP Customer Drawing C–776119, Assembly Solenoid Cover, Aug. 4, 1995.

*Primary Examiner*—Gary F. Paumen
*Assistant Examiner*—Ross Gushi

[57] ABSTRACT

An electrical connector assembly includes a plug connector 2 and a mating connector or printed circuit board header 94 that are mated with the assistance of a cam slide 4. Peripheral seals 66 and 68 surround housing bodies 21 and 23 and engage the header shroud 96. Two pockets 116, 118 are formed in the header 94 and the housing bodies 21, 23 are inserted into these cavities. Pressure relief openings or holes 112 and 114 are formed in the header shroud 96 and a hydrophobic membrane 122, 124 covers corresponding openings. These membranes permit passage of air as the connectors are mated to prevent pressure buildup, but water or other liquids cannot penetrate into the sealed portion of the assembly.

20 Claims, 6 Drawing Sheets

50
38
50
52
52
74
2
24
26
26
46
54
42
22
48
28
26
70
20
26
34
36
12
40
6
4
12
16
8
10

ELECTRICAL CONNECTOR WITH GAS EXCHANGE MEMBRANE

BACKGROUND OF THE INVENTION

1. Field of the Invention

This invention is related to electrical connectors. More specifically this invention is directed to sealed electrical connectors in which significant mating force must be overcome.

2. Description of the Prior Art

Electrical connectors of the type used in automotive and other applications quite often employ a large number of terminals and are often sealed. Many electrical connectors of this type employ a peripheral gasket seal at the mating interface between male and female connectors. A common example of electrical connector assemblies of this type consist of a first connector attached to a wire harness that is mated with a shrouded printed circuit board header. The first connector has a peripheral elastomeric seal that surrounds the mating side of the connector housing. When the first connector is mated to the printed circuit board header, the peripheral elastomeric seal engages the inner surface of the header shroud. The seal slides along this mating surface until the two connectors are fully mated.

Connectors of this type typically exhibit a relatively high mating force. Assembly specifications include maximum mating force requirements that are chosen to prevent damage to the connectors or terminals during mating and to insure that an operator can easily and reliably mate the two connectors. One approach to overcoming high mating force is to employ a cam slide connector. Cam slides are used to increase the force available to mate two electrical connectors, especially electrical connectors containing a large number of mating contacts or terminals. U.S. Pat. No. 5,478,251 is an example of a plug connector that uses a laterally shiftable cam slide that includes cam slots which engage cam follower pins. U.S. Pat. No. 5,618,194 is another example of an electrical connector that includes a laterally shiftable cam slide. Prior art connectors of this type have been used to connect automotive wiring harnesses to components in motor vehicles. For example, a cam slide connector of this type could be employed as part of an anti-lock braking system of the type shown in U.S. Pat. No. 5,766,026.

Although cam slide and other mechanical assist connectors do provide one means for overcoming high mating forces, there is a practical limit to the mechanical advantage that can be obtained by such devices. For sealed connectors, the mating force is due not only to the force required to mate male and female terminals. There is also a mating force component that is due to piston effect created as air or gas is trapped as the peripheral seal initially engages the header shroud or other female mating surface. The trapped air is compressed while the two connectors move closer together. The volume in which this air is trapped is reduced, the pressure is greater and the mating force is increased. Indeed for most if not all applications, this mating force component due to the compression of trapped air is a significant component of the overall mating force. One prior art approach to reducing this mating force component is to bleed air as the two connectors are mated. An example of this approach is shown in U.S. Pat. No. 5,358,420, in which the connector includes a groove on the interior surface of the connector shroud. This groove permits pressure relief during mating. However, only a small groove can be employed, thus limiting the amount of pressure relief that is possible.

A larger groove could damage the seal or limit the effectiveness of the seal.

SUMMARY OF THE INVENTION

The electrical connector represented by the preferred embodiment depicted herein has a housing that includes a pocket, or pockets, into which a mating connector can be inserted. The housing includes an opening communicating with the cavity with a membrane covering the opening. The membrane permits air or a gas to pass through the membrane. When the mating connector is mated with this connector, air is not compressed as the electrical connector is mated with the mating connector, and the mating force between the two connectors is reduced.

The sealed electrical connector assembly also represented by the preferred embodiment comprises mating first and second electrical connectors. One of the connectors includes a pressure relief opening covered by a membrane. This membrane is permeable to air and impermeable to water so that air can escape as the two connectors are mated and water cannot enter the sealed electrical connector assembly.

This sealed electrical connector assembly comprises a male connector with a male connector housing and a female connector with a female connector housing. The female connector has at least one pocket into which the male connector housing is inserted as the male and female connectors are mated. A peripheral seal surrounds the male connector housing and engages the female connector housing. A pressure relief opening is located in the female connector housing. The membrane covers the pressure relief opening. The membrane permits the passage of a gas but prevents the passage of a liquid to reduce the mating force between the two connectors.

Among the advantages of this invention is that the mating forces are reduced by the amount of pressure that would otherwise occur during mating of the two connectors. This is especially significant for connectors having a large number of terminals.

This invention also improves sealing by reducing the pressure differential that can build up inside a connector during temperature and ambient pressure changes.

This invention will also improve electrical performance by allowing better heat transfer and reducing temperature rise at the contact surface.

DETAILED DESCRIPTION OF THE PREFERRED EMBODIMENT

Cam slide plug connector 2 is an electrical connector that is mated with a mating connector or printed circuit board header 94 with the assistance of a cam slide 4 that shifts laterally relative to connector 2 and header 94 as the two connectors are mated. The cam slide 4 provides additional force to mate the two connectors, each of which contain a large number of terminals.

Figure 1:
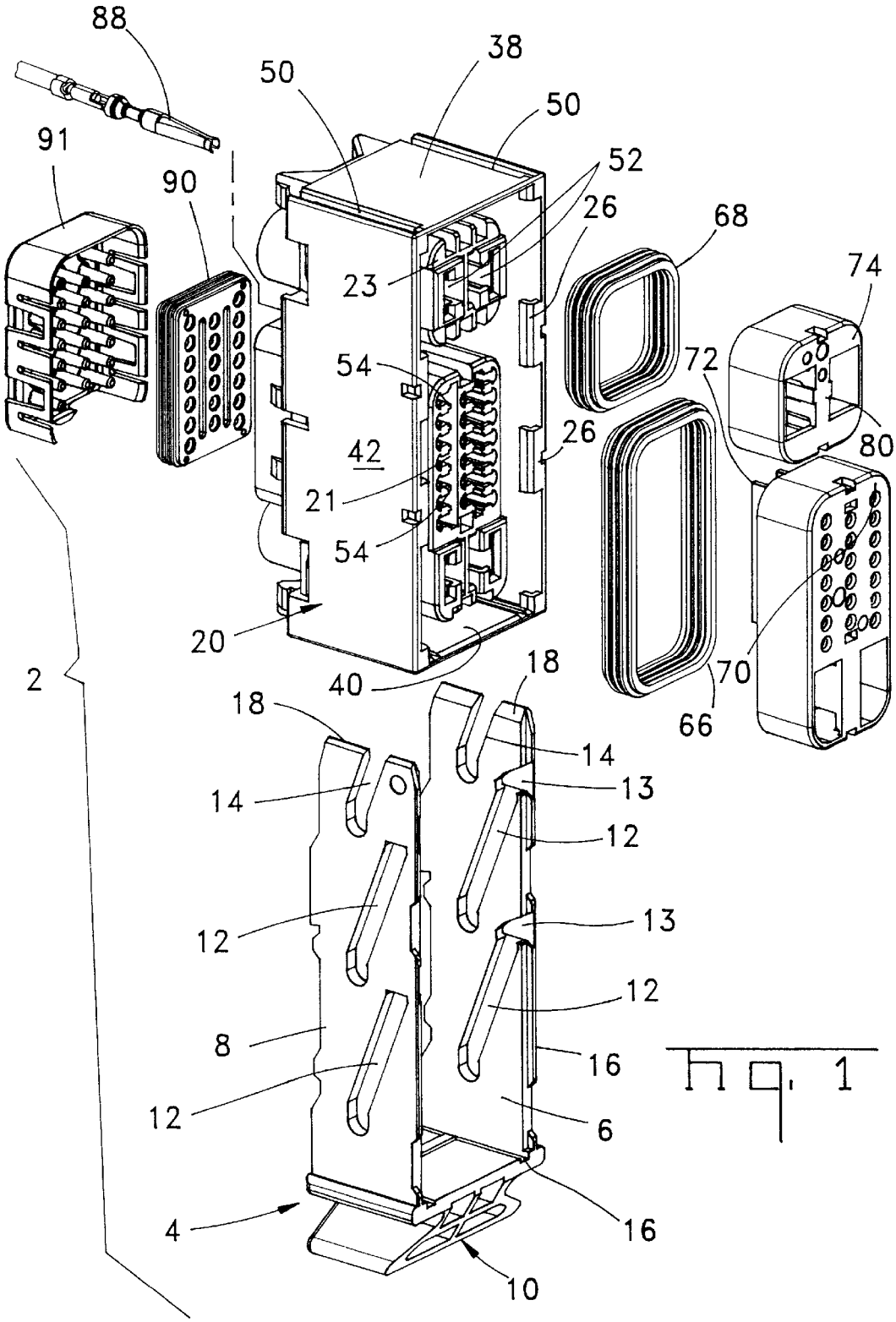
FIG. 1 is an exploded three dimensional view of a cam slide plug connector in accordance with the preferred embodiment of this invention.
Figure 2:
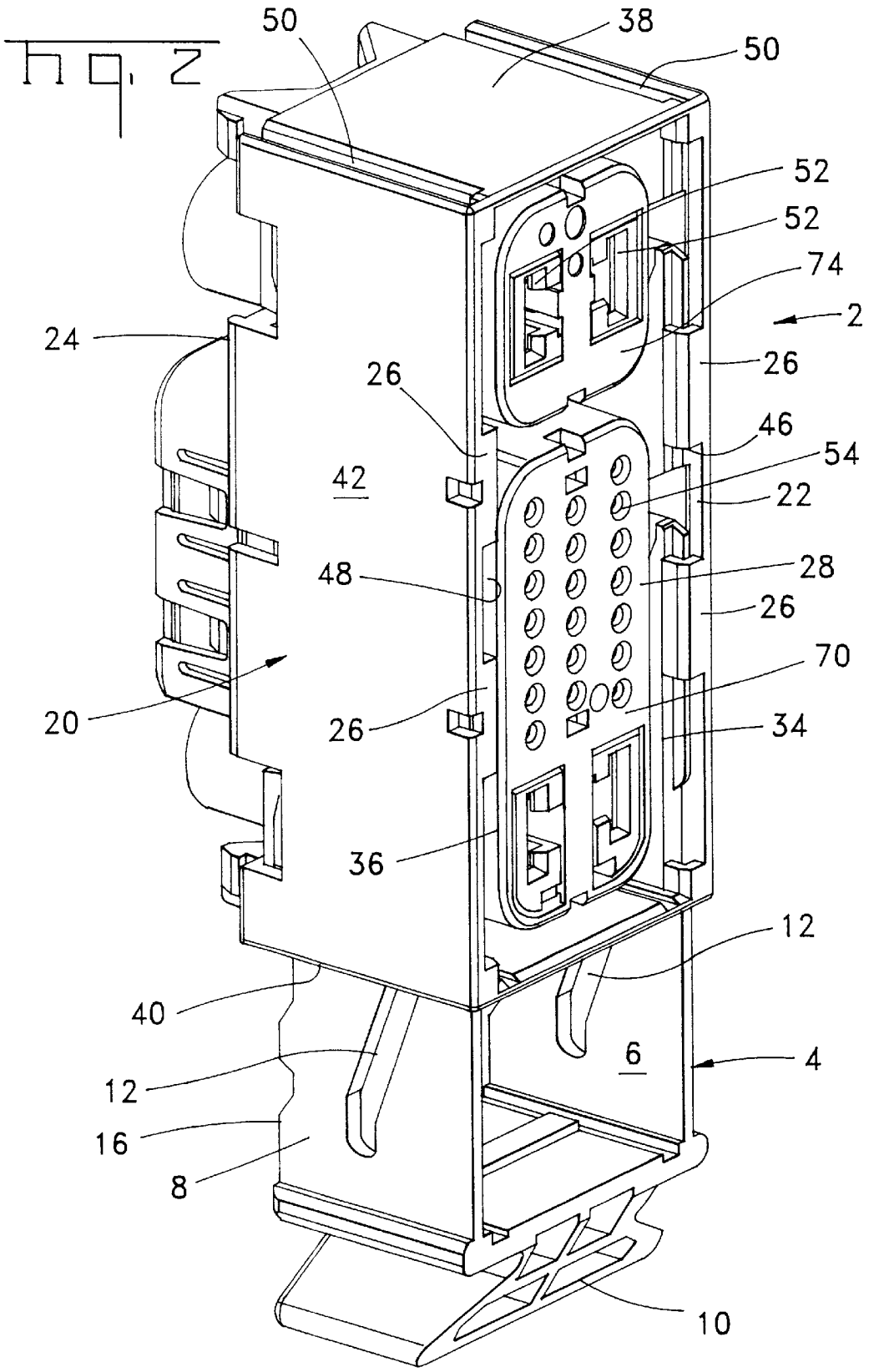
FIG. 2 is a three dimensional view of the mating face of the cam slide connector of FIG. 1 with the cam slide in an extended position.
Figure 3:
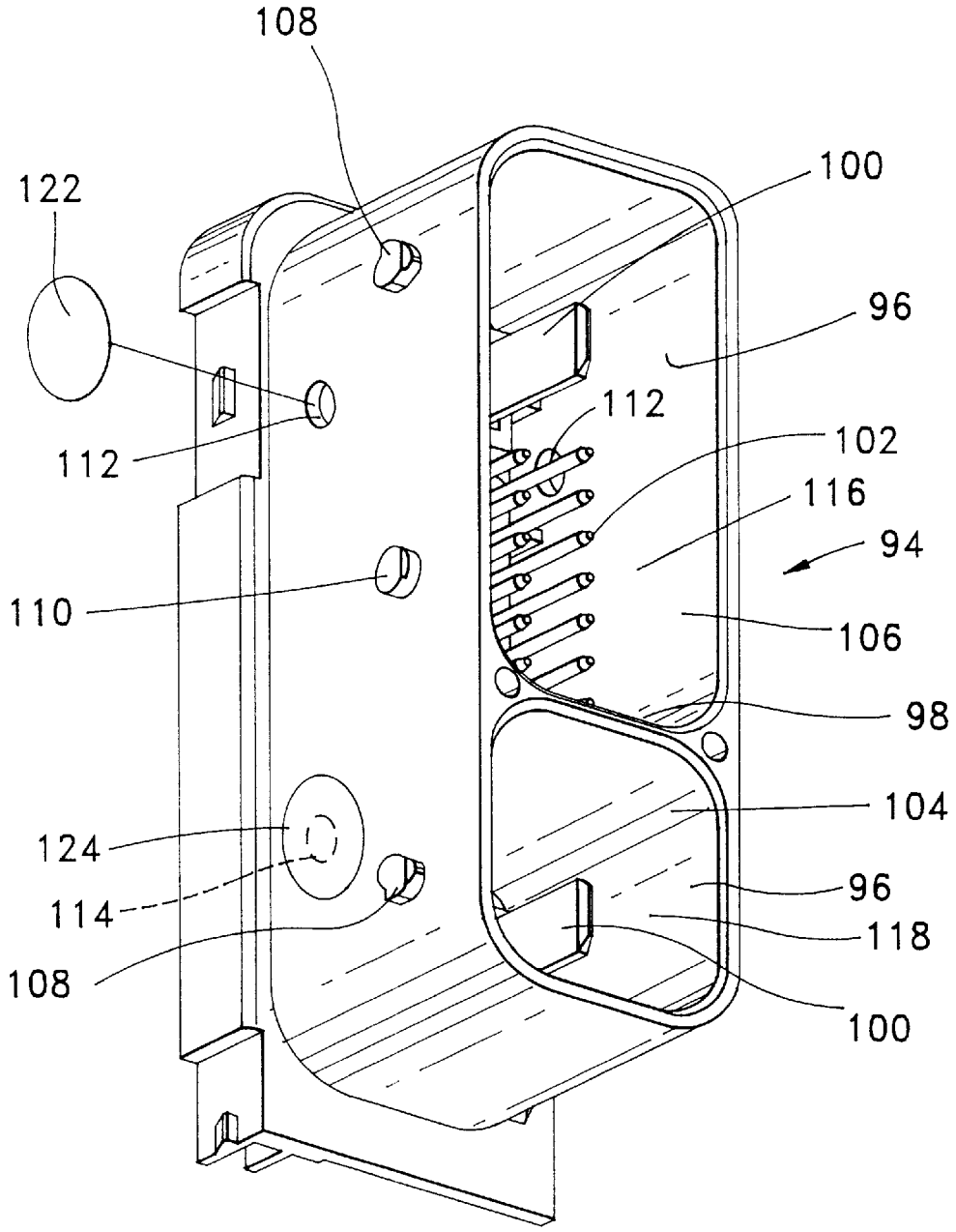
FIG. 3 is a three dimensional view of a shrouded printed circuit board header with which the cam slide plug connector is matable.

The components of the cam slide plug connector 2 are shown in FIG. 1. Terminals employed in this connector are of conventional construction and this invention can be used with electrical connectors employing a wide variety of terminals. The plug connector 2 is described in more detail in copending application Ser. No. 09/160,400 filed Sep. 25, 1998.

The cam slide 4 used in this invention is a molded plastic part. This cam slide can be injection molded from a material such as glass filled polybutylene thermoplastic (PBT), although other materials would be satisfactory. Cam slide 4 includes a first cam slide plate 6 and a parallel second cam slide plate 8, each of which extend from the edges of a center web or actuator 10. This central actuator 10 is configured to be pushed by an installer to insert the cam slide 4 or grasped by a maintenance technician to remove the cam slide 4 for separating the two mated connectors. Each cam slide plate 6 and 8 includes three cam slide slots. Two cam slide slots 12 extend from the bottom edge 16 of the cam slide plates 6 and 8. The third cam slide slot 14 is shorter in length and extends from a leading edge 18 extending generally perpendicular to bottom edge 16 on each plate 6, 8. Each of the cam slide slots 14, 16 is angled, so that as the cam slide 4 is moved laterally relative to both the plug connector 2 and the mating header 94, cam pins or cam followers 108, 110, located on the exterior of the header 94, move in the cam slots 12, 14 so that the plug connector 2 is progressively urged toward the header 94 during mating.

The cam slide 4 is insertable into plug connector housing 20 from either of two ends. The housing 20 is injection molded and is fabricated from a plastic such as glass filled PBT. Other thermoplastic resins could also be employed. Housing 20 includes a signal terminal housing body 21 and a power terminal housing body 23, each of which extend between top or mating edges 22 and bottom or rear edges 24. Housing bodies 21 and 23 extend from a rear housing wall 25. The housing 20 also includes a first sidewall 42 and a second sidewall 44 extending from the rear housing wall 25 on opposite sides of the housing bodies 21 and 23. The sidewalls 42 and 44 are spaced from the housing bodies 21 and 23 to form a first cam slide channel 46 and a second cam slide channel 48. Top rails 26, comprising molded extensions of the sidewalls 42 and 44, are located on the mating edge 22 of the housing 20. Separate top rails segments 26 are spaced apart along this edge of the sidewalls 42 and 44. Bottom molded rails 30 are located at the rear of the sidewalls 42 and 44, and comprise extensions of the rear housing wall 25 that join the sidewalls 42 and 44 to the rear housing wall 25. These rear or bottom rails 30 are separated by openings 31 that are aligned with the front or top molded rail segments 26. The openings 31 provide clearance for sections of a mold that are used to form the rails 26 located along the mating face 28 of the housing 20. By offsetting or staggering the front rails 26 and the rear rails 30, these rails can be molded by straight pull mold tooling that shift from the front and back of the housing 20 or the mold cavity used to form the housing 20.

The rails 26 and 30 retain the cam slide plates 6 and 8 in the cam slide channels 46 and 48. The cam slide plates 6 and 8 can be inserted into cam slide channels 46 and 48 through end channel slots 50 located on both ends of each of the channels 46 and 48. In other words, the cam slide 4 can be assembled to the plug connector housing 20 from either end so that the cam slide actuator 10 can be located at either end of the plug housing 20.

Plug connector 2 is a sealed electrical connector. A peripheral seal 66 surrounds the signal terminal housing body 21 and the terminals located in the signal terminal cavities 54 extending between the mating face 28 and the rear face 32. The peripheral seal 66 also extends around two power terminal cavities located in the housing body 21. Another separate peripheral seal 68 surrounds the power terminal housing body 23 which contains two power terminals that are separated from the array of signal terminals 88 in the housing body 21. In other words the power terminals in housing body section 23 are separately sealed from the terminals in the signal terminal housing body 21. Both peripheral seals 66 and 68 are of conventional construction and are substantially the same as other seals used at the interface of plug connectors and mating connectors, such as printed circuit board headers. A single mat seal 90 is located at the rear of the plug connector housing 20. This seal 90 includes a plurality of openings, each receiving a separate signal terminal 88, which is smaller than a receptacle 86 and has a lower current rating. A seal retainer 91 secures the seal 90 to the rear of the plug connector housing 20. Individual seals (not shown) surround the rear of the power terminals.

The peripheral seals 66 and 68 located on the mating face 28 of the plug connector 2 are held in position by seal retainers 70 and 74. In addition to functioning as seal retainers, these molded components 70 and 74 also function as terminal position assurance (TPA) members. Signal terminal TPA 70 includes a wedge or projection 72 that is inserted between signal terminal housing cavities 54 to support a signal terminal resilient latch, not shown, that secures a signal terminal 88 in a corresponding cavity. This signal terminal TPA 70 functions in a conventional manner.

The plug connector 2 is configured to mate with a mating connector in the form of a shrouded printed circuit board header 94. This header 94 includes power blades or pins 100 and smaller signal blades or pins 102 located in two separate arrays 104 and 106 for mating with the receptacle power terminals 86 and receptacle signal terminals 88 in the plug connector 2. These blades or pins 100 and 102 are located within cavities formed by the peripheral header shroud 96 and by a single internal wall 98 extending between opposite sides of the shroud. The interior surfaces on the shroud and the wall 98 form sealing surfaces that are engaged by the peripheral seals 66 and 68 on plug connector 2. The internal wall 98 extends between the two peripheral seals 66 and 68 so that sealing integrity is established for the two separate arrays of terminals on opposite sides of this single internal wall 98.

The shrouded printed circuit board header 94 also includes cam follower pins 108 and 110 located on opposite external sides of the shroud 96. The outer sets of pins 108 are identical and are equally spaced from the ends of the header shroud 96. These outer pins 108 are dimensioned so that they will fit in either cam slide slots 12 or 14 on the cam slide 4. The center cam follower pin 110 will fit within the center cam slide slot 12. The cam follower pins are symmetrically spaced on the header 94 so that they will enter cam slide slots 12 and 14 when the cam slide 4 is shiftable in opposite directions. The two connectors are mated by first placing the plug connector 2 over the header 94 with the cam follower pins 108, 110 aligned with the entry of the cam slide slots 12 and 14 when the cam slide 4 is in the extended positions. Note that in this position, the interior pin 108 will be aligned with the slot 14 exiting on the leading edge 18 of the cam slide 4, while the two other pins will be aligned with the cam slide slots 12 exiting along the bottom edge 16. These cam slide slots 12 include an entry section 13 that does not extend entirely through the corresponding cam slide plates 6, 8. Although the two connectors 2 and 94 can only be mated in one orientation, the cam slide 4 can be inserted from either end. This capability permits use of the same connector in different applications adjacent protruding structures that might otherwise interfere with actuation and movement of the cam slide 4. As the cam slide 4 is shifted from the extended position shown in FIG. 6 to the fully inserted position, the plug connector 2 is moved relative to the printed circuit board header 94 to the fully mated configuration. The force required to mate these two connectors is provided by the travel of the cam slide 4 and the pins 108 and 110 in cam slide slots 12 and 14.

Figure 4:
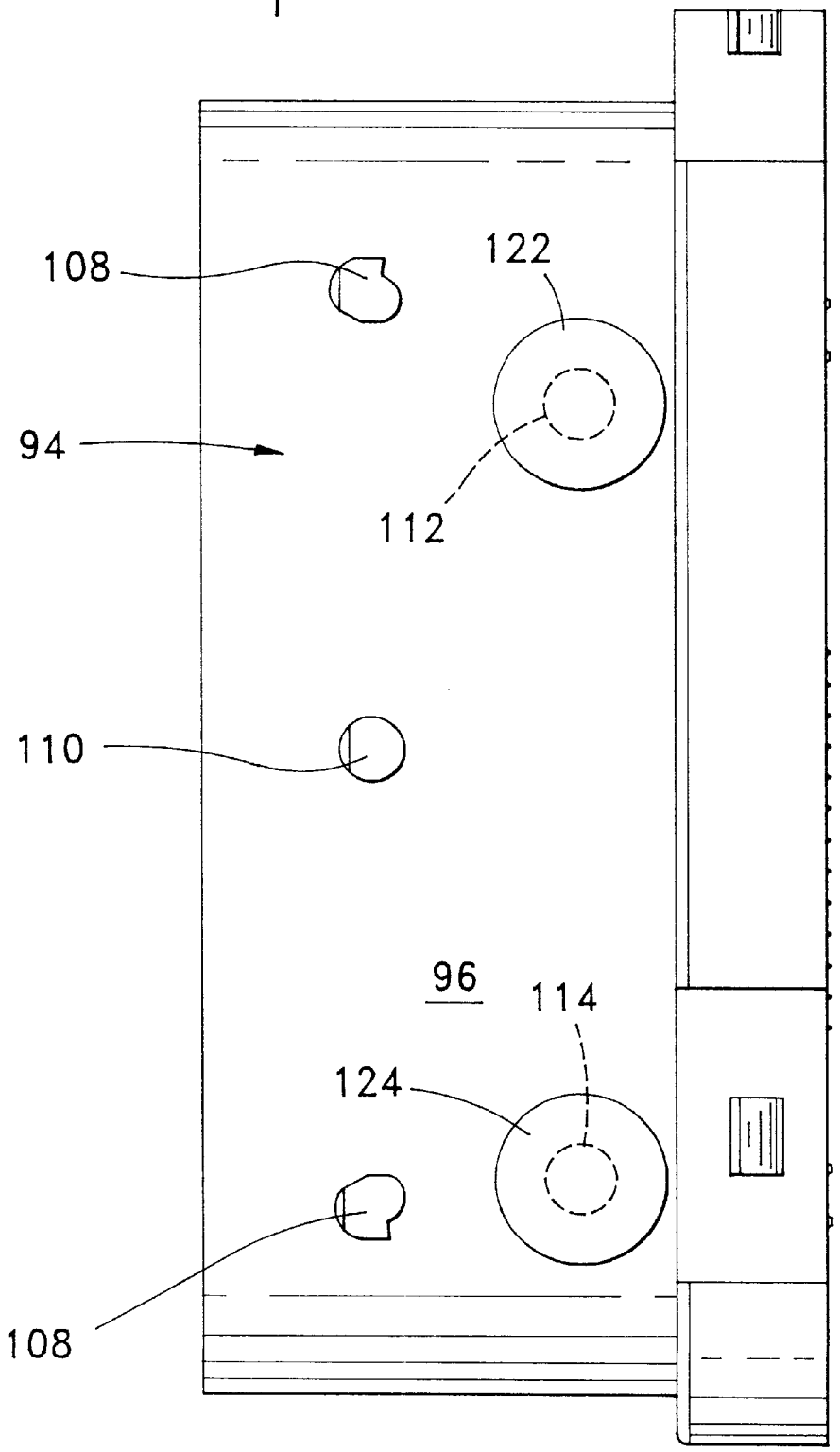
FIG. 4 is a side view of the header shown in FIG. 3.
Figure 5:
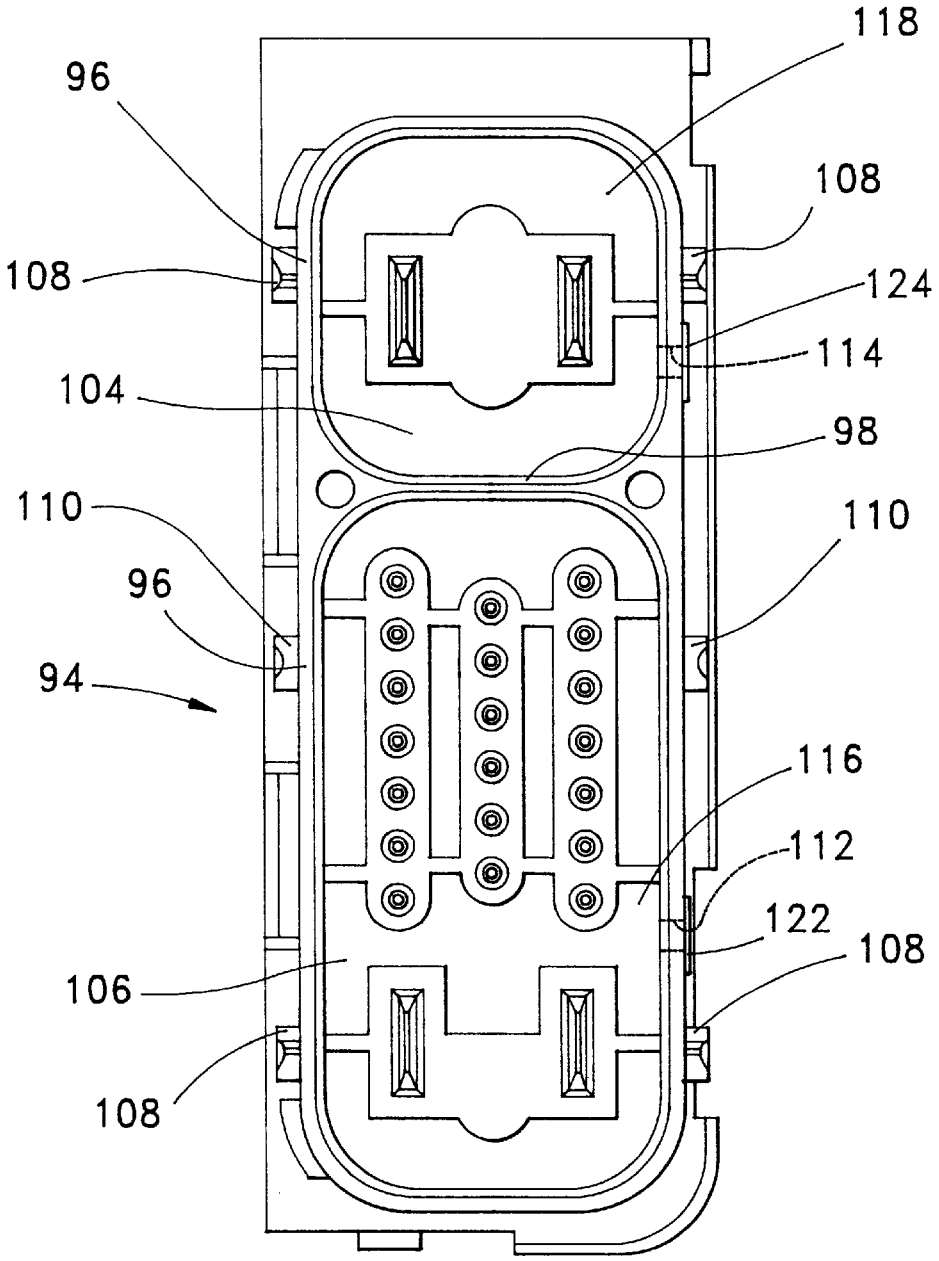
FIG. 5 is a top view of the header of FIGS. 3 and 4 showing two arrays of openings in which male pins or blades are positioned.

In the preferred embodiment of this invention pressure relief openings 112 and 114 are provided on the header shroud 96 to lower the connector mating force. In this embodiment one pressure relief opening is provided in each of the two pockets 116 and 118 formed by the internal wall 98 and the shroud 96. For a printed circuit board header having only one pocket, only one pressure relief opening would be necessary. As shown in FIG. 4, these pressure relief openings 112 and 114 are located adjacent to the header base 120. These openings 116 and 118 are located between the cam follower pins 108, 110 and the base 120. Although both openings 112 and 114 are formed on one side of the shroud 96, it should be understood that openings could be provided on opposite sides or on the ends of the shroud 96. Furthermore, multiple openings could be provided within each or both pockets 116 and 118.

Each the openings 112 and 114 comprises a hole extending through the shroud 96 that is covered by a corresponding gas discharge or hydrophobic membrane 122, 124. This microporous hydrophobic membrane is permeable to air or other gases, but is impermeable to liquids, such as water. Therefore air that might otherwise be trapped during mating of the two connectors can escape, but water or other liquids cannot pass through the membranes 122 and 124 into a sealed region of the mated connector assembly. Examples of materials from which the membranes 122 and 124 can be fabricated are the Pall Gelman Sciences FluoRepel Versapor membrane or the Pall Gelman Sciences Hydrolon Nylon 6,6 membrane. Other hydrophobic membranes can also be employed. In the preferred embodiment of this invention, each membrane 122, 124 is in the form of a commercially available disk with a suitable adhesive on one surface of the disk. The membrane disks 122, 124 can thus be easily secured over the respective openings 112, 114 in the shroud 96. Membranes can however be secured by other conventional means. Counterbored sections surounding holes or openings 112, 114 can also be provided so that the disks 122, 124 can be mounted in recessed areas so that the disks will be substantially flush with the outer surface of the shroud where they will be less subject to damage.

Figure 6:
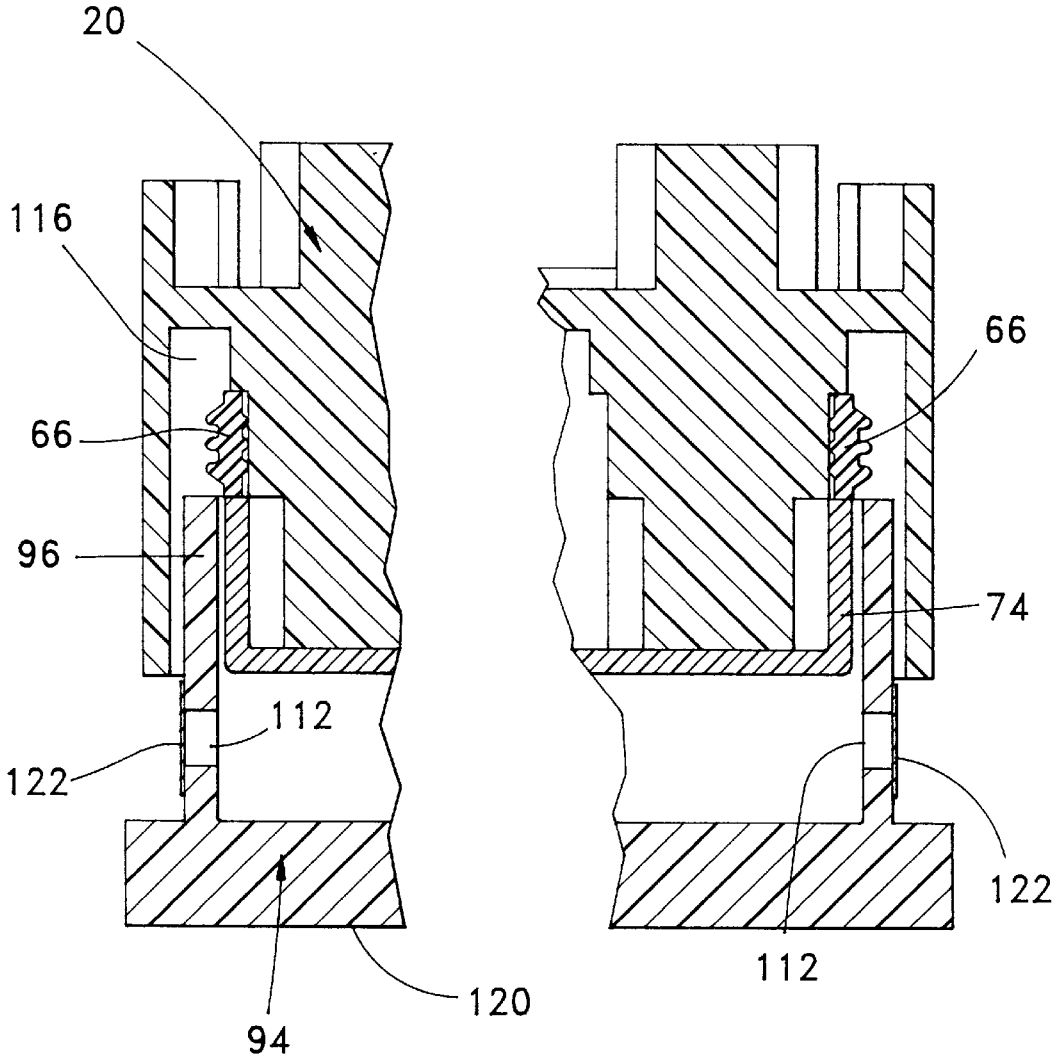
FIG. 6 is a view showing the manner in which gas is trapped and the gas must be compressed in order to mate two sealed electrical connectors.

FIG. 6 shows the manner in which the membranes 122, 124 act to relieve air pressure as the connectors are mated. FIG. 6 shows the relative position of the plug connector 2 and the printed circuit board header 94 when the peripheral seal 66 first engages the shroud 96. At this point the volume of air between the top and the bottom of the shroud 96 would be trapped by the peripheral seal 66, or corresponding seal 68 and by seals, such as mat seal 90 or individual seals surrounding individual wires and terminals, but for the opening 112 and the air relief membrane 122. If that air were trapped it would be compressed as the plug connector 2, and the gasket seal 66 mounted on the plug connector approached the header base 120. As the available volume decreased, the air pressure would increase which in turn would increase the mating force. However, the gas relief membrane 122 permits the trapped air to escape through the hole 112 eliminating any pressure buildup or piston effect. Since the membrane 122 is hydrophobic or relative impervious to water, there will be no leakage through the membrane 122 into the sealed area of the mated connector assembly. Membrane 124 acts in the same way in pocket 118.

The representative embodiment depicted herein is merely one example of an electrical connector assembly incorporating this invention. This invention is not limited to use with a printed circuit board header, nor is this invention limited to use with connectors that include mechanical assist members, such as cam slides. This invention is also not limited to connectors in which the pressure relief openings and the membrane are located on the sidewalls of a housing shroud. For example, the relief openings could be located in the base of the housing and the relief opening could comprise an unpopulated terminal opening over which a hydrophobic membrane is located. Therefore this invention is not limited to the representative embodiment depicted herein and is instead defined by the following claims.

I claim:

1. An electrical connector comprising a housing including a pocket into which a mating connector can be inserted, the housing including an opening communication with the pocket with a membrane attached to the housing covering the opening, the membrane permitting air to pass through the membrane, but preventing the passage of a liquid, so that air is not compressed as the electrical connector is mated with the mating connector.

2. The electrical connector of claim 1 wherein the pocket is formed by walls extending upward from a base.

3. The electrical connector of claim 2 wherein the opening comprises a hole in one of the walls.

4. The electrical connector of claim 3 wherein the walls include a smooth interior surface so that a seal engaging the interior surface will prevent the passage of a liquid between the seal and the walls.

5. The electrical connector of claim 4 comprising a shrouded printed circuit board header.

6. A sealed electrical connector assembly comprising mating first and second electrical connectors, one of the connectors including a housing with a pressure relief opening covered by a membrane attached to the housing that is permeable to air and impermeable to water so that air can escape as the two connectors are mated and water cannot enter the sealed electrical connector assembly.

7. The sealed electrical connector assembly of claim 6 wherein a peripheral seal is located at the interface between the first and second electrical connectors.

8. The sealed electrical connector assembly of claim 6 wherein the pressure relief opening comprises a hole in a housing of only one of the first and second electrical connectors.

9. The sealed electrical connector assembly of claim 6 wherein the membrane seal comprises a disk adhesively attached over the pressure relief opening.

10. The seal electrical connector assembly of claim 9 wherein the disk is mounted on an exterior surface of one of the electrical connectors.

11. A sealed electrical connector assembly comprising a male connector with a male connector housing and a female connector with a female connector housing having a pocket into which the male connector housing is inserted as the male and female connectors are mated; a peripheral seal surrounding the male connector housing and engaging the female connector housing; a pressure relief opening in the female connector housing; and a membrane attached to the female connector housing covering the pressure relief opening, the membrane permitting the passage of a gas but preventing the passage of a liquid to reduce the mating force between the two connectors.

12. The electrical connector assembly of claim 11 wherein the membrane comprises a hydrophobic membrane.

13. The electrical connector assembly of claim 11 wherein the membrane comprises a disk adhesively secured to the exterior of the female connector housing.

14. The electrical connector assembly of claim 11 further comprising terminals in each of the connector housings with seals surrounding each of the terminals.

15. The electrical connector assembly of claim 11 wherein the female electrical connector housing includes multiple pockets, each pocket having a pressure relief opening and a membrane covering the corresponding pressure relief opening.

16. The electrical connector assembly of claim 11 wherein the pocket is formed by walls which surround the male connector when the two connectors are fully mated.

17. The electrical connector assembly of claim 16 wherein the opening is located in one of the wall forming the pocket.

18. The electrical connector assembly of claim 17 wherein the female connector comprises a printed circuit board header.

19. The electrical connector assembly of claim 11 further including a mechanical assist member for mating the male connector housing to the female connector housing.

20. The electrical connector assembly of claim 14 wherein the openings are located between the seals surrounding the terminals and the peripheral seal when the male and female electrical connectors are fully mated.

* * * * *